US005865078A

United States Patent [19]

Langford

[11] Patent Number: 5,865,078

[45] Date of Patent: Feb. 2, 1999

[54] SPORTS SHOE SPIKE REMOVAL TOOL

[76] Inventor: Don Langford, 621 S. Fir, Chandler, Ariz. 85226

[21] Appl. No.: 894,890

[22] PCT Filed: Nov. 3, 1995

[86] PCT No.: PCT/US95/14164

§ 371 Date: Aug. 28, 1997

§ 102(e) Date: Aug. 28, 1997

[87] PCT Pub. No.: WO96/28281

PCT Pub. Date: Sep. 19, 1996

[51] Int. Cl.[6] ..... B25B 23/08

[52] U.S. Cl. ..... 81/441; 81/461; 81/176.15

[58] Field of Search ..... 81/176.15, 461, 81/441, 53.2, 177.5, 177.2, 177.1

[56] References Cited

U.S. PATENT DOCUMENTS

| | | | |
|---|---|---|---|
| 1,319,028 | 10/1919 | Grinnell | 81/441 |
| 2,881,648 | 4/1959 | Hottle | 81/176.15 |
| 3,797,055 | 3/1974 | Greene | 81/441 |
| 3,903,762 | 9/1975 | Acrea | 81/176.15 |
| 4,270,418 | 6/1981 | Shephard | 81/441 |
| 4,426,896 | 1/1984 | Kesselman | 81/441 |
| 4,542,666 | 9/1985 | White | 81/177.5 |
| 4,679,468 | 7/1987 | Gray | 81/176.15 |
| 4,713,990 | 12/1987 | Poling | 81/53.2 |
| 5,072,634 | 12/1991 | Ryder | 81/176.15 |

*Primary Examiner*—David A. Scherbel
*Assistant Examiner*—Joni B. Danganan
*Attorney, Agent, or Firm*—Parsons & Goltry; Robert A. Parsons; Michael W. Goltry

[57] ABSTRACT

A spike removal tool (30, 50, 60, 70, 90, 110) for removing spike elements (14, 125) from sporting shoes (10), the spike elements (14, 125) rotatable in a first direction relative to the shoe (10) for installation and rotatable in a second direction relative to the shoe (10) for removal, the tool (30, 50, 60, 70, 90, 110) including a tool head (35, 52, 62, 72, 92, 112) having an axis of rotation, rotatable in the second direction to engage the spike element (14, 125) and including a first surface (38, 53, 73, 93, 113), a second surface (39, 52A, 62A, 72A, 93A, 113A) opposing the first surface, an engagement means carried by the first surface (38, 53, 73, 93, 113), for engaging the spike element (14, 125) and a bore (42, 55, 65, 75, 95, 117) extending centrally through the first surface into the tool head (35, 52, 62, 72, 92, 112) toward the second surface (39, 52A, 62A, 72A, 93A, 113A) along the axis of rotation, a shank (32, 51, 61, 71, 91, 111) extending from the second surface of the tool head (35, 52, 62, 72, 92, 112) and having an axis of rotation generally perpendicular to the first surface of the tool head and co-axial with the bore (42, 55, 65, 75, 95, 117).

6 Claims, 4 Drawing Sheets

FIG. 12
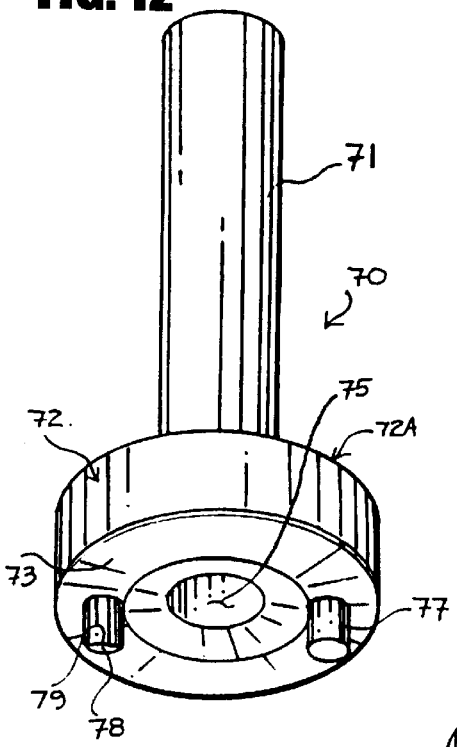
FIG. 14
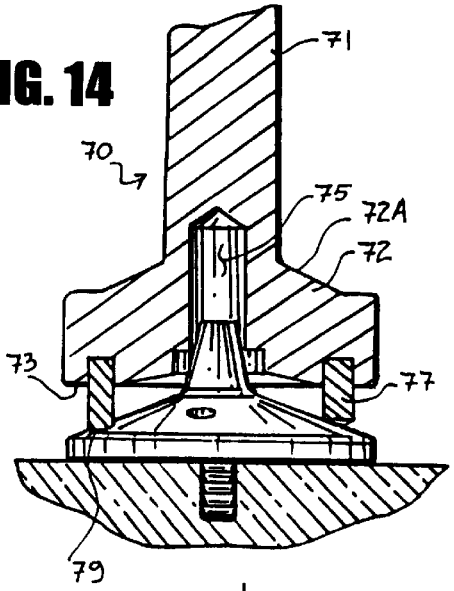
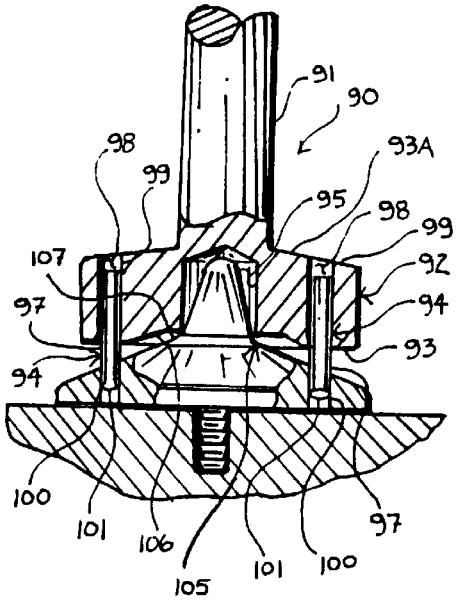
FIG. 16
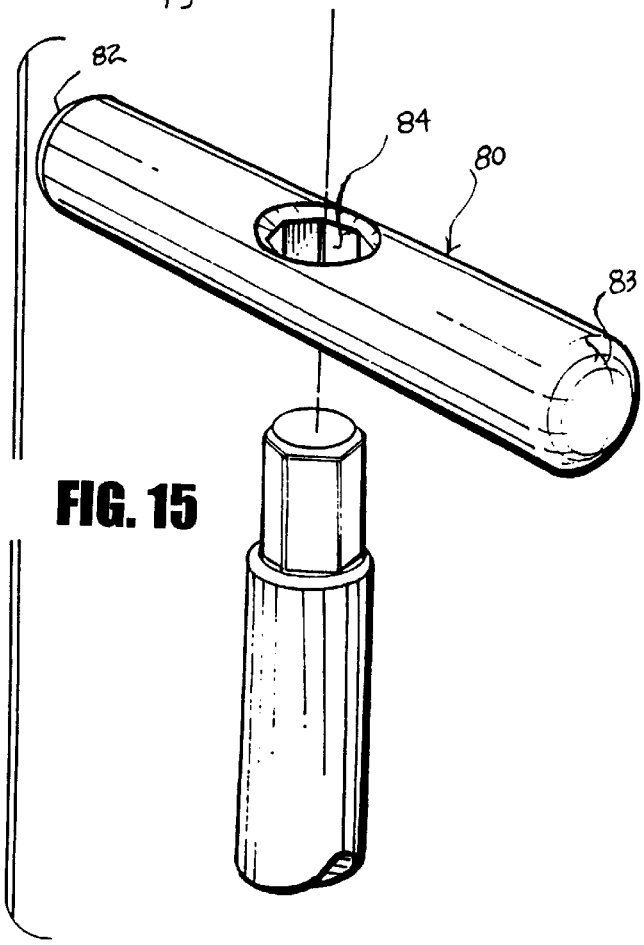
FIG. 15

SPORTS SHOE SPIKE REMOVAL TOOL

TECHNICAL FIELD

This invention relates to accessories for sporting equipment.

More particularly, the present invention relates to the installation and removal of spikes from sports shoes.

In a further and more specific aspect, the present invention concerns tools for the removal of worn and damaged spikes from sports shoes.

BACKGROUND ART

In many sporting events, traction is an important element. In a sport requiring a great deal of running, traction is an obvious requirement. In other sporting events such as golf, running is not a requirement, but traction is still a very important element for success. Over the years shoes have been developed to provide the necessary traction. These shoes employ spikes projecting from the sole, and often from the heel. In shoes specialized for a particular sport, the spikes are often fixed in position. The drawback to this type of shoe is that only one type of spike may be employed, and over time the spikes will become worn. The worn spikes cannot be replaced, so the shoe must be discarded even if otherwise in good shape.

To overcome the problem of worn spikes on usable shoes and to provide a shoe potentially capable of being fitted with different types of spikes, a shoe having removable spikes was developed. This shoe has threaded apertures into which threaded spike elements can be fitted. When the spikes become too worn, they are simply replaced with new spikes.

While this sounds like a very simple and effective solution to the problem, and in theory works very well, in practical application, problems arise. When spikes are used over a period of time, they become dirty, worn and deformed. This standard wear and tear often makes the spikes difficult to remove. As an example, golf shoes typically employ metal spike elements consisting of a disk shaped base from which a threaded post extends in one direction and a spike extends in an opposing direction. To facilitate insertion and removal of a spike element, a pair of apertures is formed in the disk shaped base. The apertures are configured to receive the pins of a spanner type tool, which is then used to unthread and remove the spike or thread the spike into a shoe. The problem occurs when the spike element is worn for a period of time. Dirt, pebbles and other extraneous matter is often jammed into the apertures preventing the insertion of the pins of the spanner. When this occurs, the apertures must be cleaned out, which is often difficult if not impossible. Also, after much use, the disk shaped base becomes worn, and battered. This is precisely when a spike becomes worn down and should be replaced. Much of the time the apertures become deformed and will not receive the pins of the spanner, or they become so worn down that the apertures have very little depth and thus will not retain the pins. Therefore it is when the spike elements should be removed and replaced that removal becomes a problem.

DISCLOSURE OF THE INVENTION

It would be highly advantageous, therefore, to remedy the foregoing and other deficiencies inherent in the prior art.

Accordingly, it is an object of the present invention to provide a new and improved spike removal tool.

Another object of the present invention is to provide a tool which will easily remove worn, deformed or otherwise difficult to remove spikes.

And another object of the present invention is to provide a spike removal tool which is relatively inexpensive.

Still another object of the present invention is to provide a spike removal tool which is relatively simple to use.

Yet another object of the present invention is to provide a spike removal tool which may be used in combination with a conventional drill.

Yet still another object of the present invention is to provide a spike removal tool which can be used to remove a large variety of spikes.

A further object of the present invention is to provide a spike removal tool which will not damage the shoe from which the spikes are removed.

Briefly, to achieve the desired objects of the present invention in accordance with a preferred embodiment thereof, provided is a spike removal tool for removing spike elements from sporting shoes. The spike elements are rotatable in a first direction relative the shoe for installation and rotatable in a second direction relative the shoe for removal. The tool has a tool head with an axis of rotation and including a first surface, a second surface opposing the first surface, an engagement means carried by the first surface for engaging the spike element, and a bore extending centrally through the first surface into the tool head toward the second surface along the axis of rotation. Also included in the tool is rotating means for rotating the tool head in the second direction.

In a specific embodiment, rotating means includes a shank extending from the second surface of the tool head and having an axis of rotation generally perpendicular to the first surface of the tool head and co-axial with the bore. The shank is configured to be receivable by a conventional rotating tool.

In another embodiment the engagement means includes a plurality of blades, of which comprise an engagement element, extending from the first surface, the plurality of blades configured to engage the spike element upon rotation in the second direction. The plurality of blades extend radially outward from proximate the bore angled in the second direction with respect to the first surface.

In a further embodiment, the tool head is generally cylindrical with the first surface sloping inward from a periphery thereof toward the bore.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 12 is a perspective view of a spike removal tool showing yet another embodiment of an engagement element;

FIG. 14 is a sectional side view of the spike removal tool of FIGS. 12 and 13, as it would appear engaging a spike element; and FIG. 15 is a perspective view of a handle couplable to the shank of the spike removal tools.

FIG. 16 is a side elevational view of an alternate embodiment of the instant invention with portions thereof broken away for purposes of illustration;

BEST MODES FOR CARRYING OUT THE INVENTION

Figures 1, 2, 3, 4, 5:
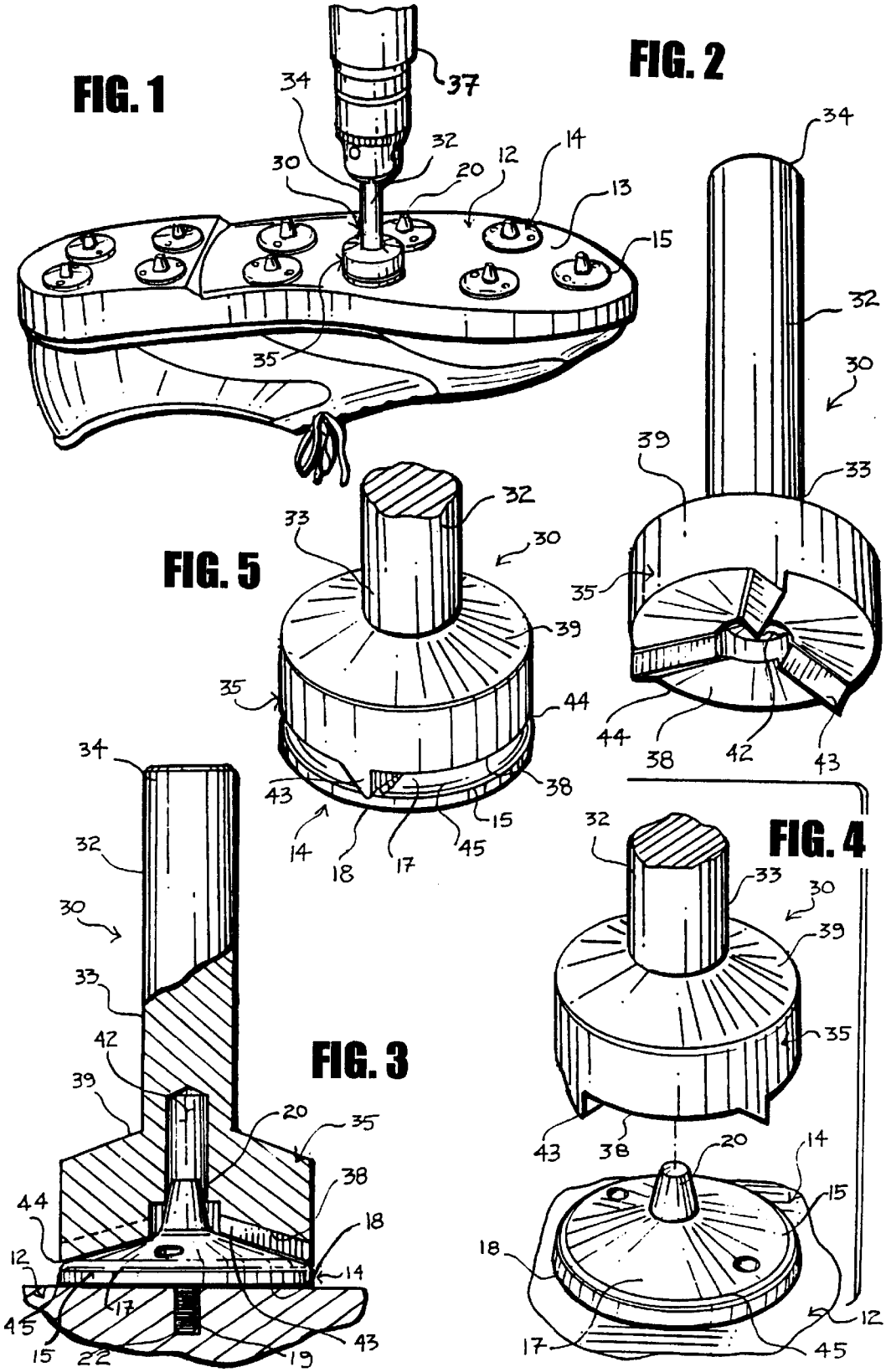
FIG. 1 is a perspective view illustrating a spike removal tool constructed in accordance with the teachings of the present invention, as it would appear being employed to remove a spike element from a shoe.
FIG. 2 is a perspective view of the spike removal tool of FIG. 1.
FIG. 3 is a sectional side view of the spike removal tool of FIGS. 1 and 2, as it would appear engaging a spike element.
FIG. 4 is a partial perspective view of the spike removal tool of FIGS. 1, 2 and 3, as it would appear prior to engaging a spike.
FIG. 5 is a partial perspective view of the spike removal tool of FIGS. 1, 2, 3 and 4, as it would appear in engagement with a spike.
Figure 6:
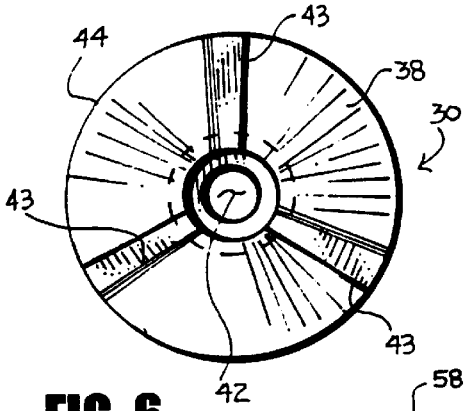
FIG. 6 is a bottom plan view of the spike removal tool.

Turning now to the drawings in which like reference characters indicate corresponding elements throughout the several views, attention is first directed to FIG. 1 which illustrates a sport shoe generally designated 10. Sport shoe 10 is specifically illustrated as a golf shoe including a sole 12, a bottom surface 13 and a plurality of spike elements 14 extending therefrom. It will be understood that other types of shoes employing removable spike elements may be serviced by the present invention, and that golf shoe 10 is shown solely for purposes of reference. With additional reference to FIG. 3, it can be seen that spike element 14 includes a disk shaped base 15 having an outer surface 17 and an inner surface 18. A threaded post 19 extends from inner surface 18 and a spike 20 projects from outer surface 17. Spike element 14 is coupled to sole 12 by rotatably inserting threaded post 19 into a threaded socket 22 formed into sole 12. Spike element 14 is rotated in a first direction for installation and rotated in a second direction for removal. It is conventional for threaded elements to be rotated in a clockwise direction for engagement and counter-clockwise for removal, but it will be understood that the directions may be reversed.

Still referring to FIG. 1, when spike elements 14 become worn, deformed or otherwise rendered difficult to remove, a spike removal tool generally designated 30 is employed to aid in removal. Spike removal tool 30 includes a shank 32 having opposing ends 33 and 34, and a tool head 35 coupled to end 33. End 34 is configured to be received by a rotating device such as a drill 37. In this embodiment, it is assumed that a counter-clockwise rotation of spike element 14 will remove it from shoe 10. Therefore, drill 37 must be reversible to rotate spike removal tool 30 in a counter-clockwise direction. It must be noted that clockwise removal of spike element 14 may also be possible. In that case a drill or other rotating device would not need to be reversible.

Turning now to FIG. 2, tool head 35 is generally cylindrical and includes a first surface 38, a second surface 39 opposing first surface 38, and engagement means carried proximate the first surface 38 for engaging disk shaped base 15 of spike element 14, and a bore 42 extending centrally through first surface 38 into tool head 35 toward second surface 39 along an axis of rotation of tool head 35. Shank 32 extends generally centrally from second surface 39 of tool head 35 and has an axis of rotation generally perpendicular to first surface 38 of tool head 35 and co-axial with bore 42. The engagement means preferably consists of projections for engaging spike element 15, and in this embodiment, includes a plurality of blades 43 extending from first surface 38. Preferably three blades 43 radiating outward from bore 42 in an equal spaced apart relation are used, but it will be understood that two or more blades made be employed, and even one blade may be employed if desirable. Blades 43 each extend from the edge of bore 42 to proximate a peripheral edge 44 of first surface 38. To enhance engagement with spike element 14, each blade 43 is sloped in the direction of rotation for the removal of the spike element.

Referring again to FIG. 3, first surface 38 may be concave, sloping inward from peripheral edge 44 toward bore 42. Many disk shaped bases 15 of spike elements 14 have a convex outer surface 17 which slopes downward from spike 20 to sole 12. The concave shape of first surface 38 compensates for the convex outer surface 17 of disk-shaped base 15. Blades 43 will have a corresponding slope which will insure blades 43 contacting disk shaped base 15 along their entire length. It will be understood that a planar surface may be used, which will work on sloped bases since a portion of blades 43 will contact and engage disk-shaped base 15 permitting removal, but a better engagement is established with blades 43 corresponding closer to the slope of the base. It has been found that a slope of 15–16 degrees is preferred, but may be varied as desired.

Turning now to FIG. 4, in operation spike removal tool 30 is placed in contact with spike element 14 by placing tool head 35 directly over spike 20 of spike element 14. With additional reference to FIG. 3, spike 20 is received within bore 42 permitting blades 43 to fully contact outer surface 17 of spike element 14. Bore 42 may extend completely through tool head 35 and into shank 32 to accommodate longer spikes. Spike element 14 is removed by rotating spike removal tool 30 in the direction of removal, generally counter-clockwise, which engages blades 43 with outer surface 17. In many spike elements, specifically those used on golf shoes, a plastic coating 45 covers disk shaped base 15 which is fabricated of metal. Upon rotation of spike removal tool 30, blades 43, which are angled into the direction of rotation, gouge into plastic coating 45, and securely grip spike element 14. Continued rotation of spike removal tool 30 causes a corresponding rotation of spike element 14. Upon sufficient rotation, threaded post 19 will be removed from threaded socket 22 and spike element 14 removed from shoe 10.

To rotate spike removal tool 30, shank 32 is configured to be received by a conventional rotating device such as drill 37. For the best results, a drill 37 which operates at approximately 500 RPM, with a forward and a reverse feature should be used. The reverse feature is necessary to rotate spike element 14 in the counter-clockwise direction for removal, and the slower revolutions per minute allow for a better engagement between blades 43 and spike element 14.

While a spike element 14 having a plastic coating 45 is shown, some spikes are entirely fabricated of plastic or metal. Spike removal tool 30 will engage either type for removal of the spike element. This is accomplished by fabricating spike removal tool 30, and specifically blades 43, of tool or tempered steel. In this manner, blades 43 will retain a sharp edge which will readily engage substantially any spike element whether fabricated of plastic, metal, etc.

Figure 7:
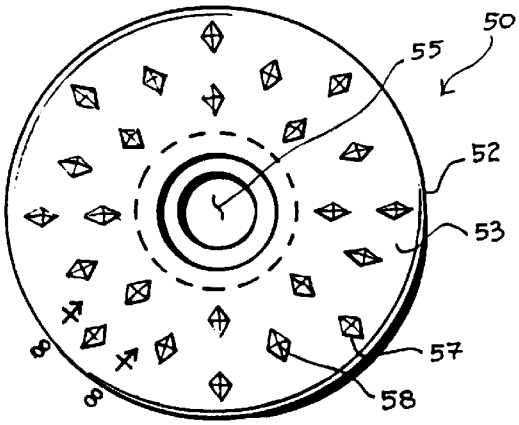
FIG. 7 is a bottom plan view of a spike removal tool showing another embodiment of an engagement element.
Figure 8:
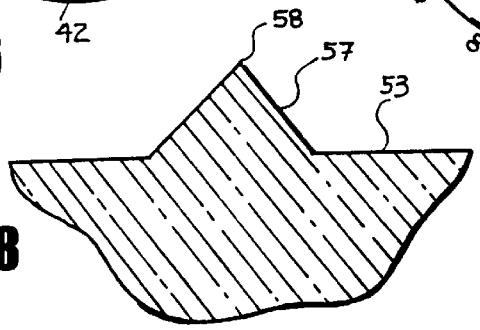
FIG. 8 is a sectional view taken along line 8—8 of FIG. 7.
Figure 9:
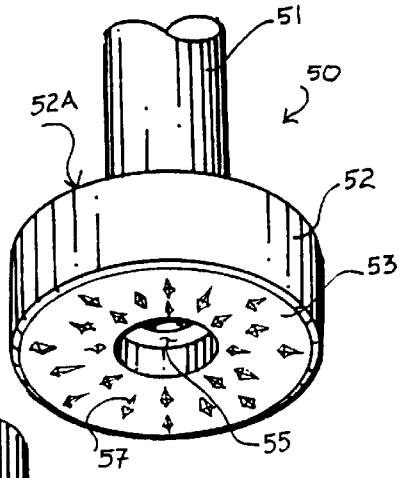
FIG. 9 is a perspective view of the spike removal tool of FIG. 7.

Turning now to FIGS. 7 and 8, a spike removal tool generally designated 50 is illustrated. Spike removal tool 50 is similar to spike removal tool 30, in that it has the same elements, including a shank 51, a tool head 52 having a first surface 53 and a second surface 52A, engagement means carried by first surface 53 for engaging disk shaped base 15 of spike element 14, and a bore 55 extending centrally through first surface 53 into tool head 52.

Spike removal tool 50 differs from spike removal tool 30 in the embodiment of the engagement means. In this embodiment, the engagement means consists of a plurality of teeth 57 extending outward from first surface in an alternating pattern as shown. Teeth 57 may be of substantially any shape, but are shown having a diamond shape and terminating in a point 58. Spike removal tool 50 is employed and operates in substantially the same manner as spike removal tool 30, and has been included to illustrate that blades 43 and teeth 57 may be of a variety of different configurations, but generally being projections extending from the surface of the tool head which are capable of engaging, generally cutting into, outer surface 17 of spike elements 14.

Figure 10:
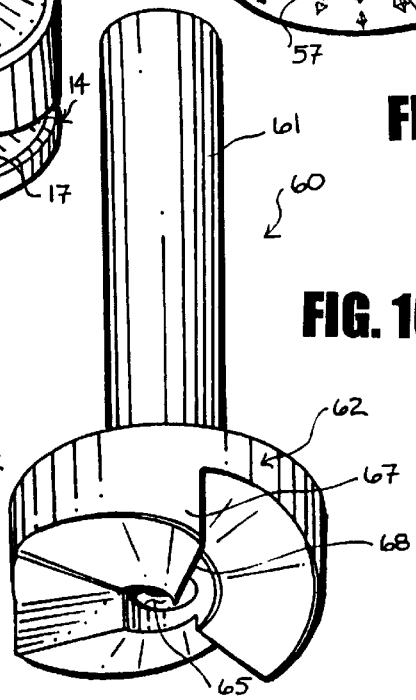
FIG. 10 is a perspective view of a spike removal tool showing another embodiment of an engagement element.

Turning now to FIG. 10, a spike removal tool generally designated 60 is illustrated. Spike removal tool 60 is similar to spike removal tool 30 and 50, in that it has the same elements, including a shank 61, a tool head 62 having a second surface 62A, engagement means for engaging disk shaped base 15 of spike element 14, and a bore 65 extending centrally through tool head 62.

Figure 11:
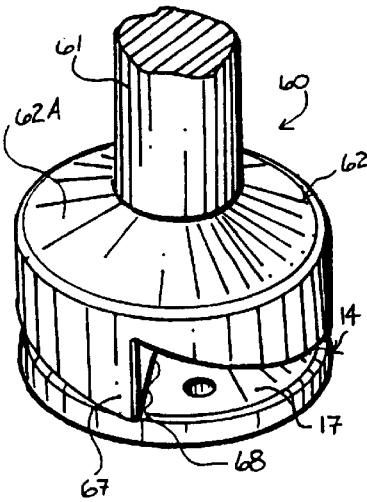
FIG. 11 is a perspective view of the spike removal tool of FIG. 10, as it would appear engaging a spike element.

Spike removal tool 60 differs from spike removal tools 30 and 50 in the embodiment of the engagement means. In this embodiment, the engagement means consists of flutes 67 formed in tool head 62 and encircling bore 65. With additional reference to FIG. 11, flutes 67 terminate in edges 68 extending from bore 65 to an outer circumference of tool head 62. Edges 68 engage outer surface 17 of spike elements 14 to facilitate removal thereof.

Figure 13:
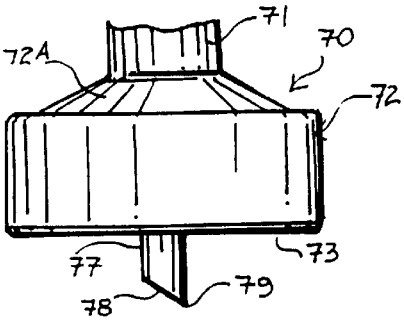
FIG. 13 is a side view of the spike removal tool of FIG. 12.

Referring now to FIGS. 12 and 13, yet another embodiment of a spike removal tool generally designated 70 is illustrated. Spike removal tool 70 is similar to spike removal tool 30, 50 and 60, in that it has the same elements, including a shank 71, a tool head 72 having a first surface 73 and a second surface 72A, engagement means carried by first surface 73 for engaging disk shaped base 15 of spike element 14, and a bore 75 extending centrally through first surface 73 into tool head 72.

Spike removal tool 70 differs from spike removal tools 30, 50 and 60 in the embodiment of the engagement means. In this embodiment, the engagement means consists of a pair of diametrically opposed lugs 77 extending from first surface 73. Lugs 77 are parallel to the axis of rotation of spike removal tool 70. Lugs 77 terminate in a surface 78 sloping away from tool head 72 and in a counter clockwise direction with respect to the rotation thereof. Thus, one side of each lug 77 is longer than the other side, forming an edge 79. In other words, when tool 70 is rotated in a clockwise direction, the shorter side of each lug 77 is leading. When rotated in the counter clockwise direction, edges 79 of lugs 77 are leading.

In operation, tool 70 can be used as a spanner to install a spike element by inserting lugs 77 into the corresponding openings formed in disk shaped base 15 and rotating clockwise. Tool can also be used to remove spike element by inserting lugs in the openings formed in disk shaped base 15 and rotating in a counter clockwise direction. In addition, if the openings are worn or damaged beyond using, tool 70 can be used to remove the spike element by engaging outer surface 17 with edges 79 of lugs 77 and turning in a counter clockwise direction as shown in FIG. 14. With edges 79 leading during counter clockwise rotation of tool 70, the edges 79 act as an engagement element by cutting into outer surface 17 and thus engaging the spike element.

Turning to FIG. 15, a handle 80 can be provided to facilitate removal of spike elements when power tools are unavailable or inconvenient. Handle 80 is an addition to tools 30, 50, 60 and 70 to permit manual removal of spike elements. With tool 70, handle 80 also permits installation of spike elements. Handle 80 is preferably a cylindrical segment having opposing ends 82 and 83. The free end of tools 30, 50, 60 and 70 are generally square or hexagonal as illustrated, to be received by a drill. A corresponding socket 84 is formed in or through handle 80 to receive the free end of the tool. The shape prohibits rotation of the shank within socket 84 of handle 80. In this manner, tools may be rotated by hand to remove, and in some embodiments to install, spike elements.

Turning now to FIG. 16, still a further embodiment of a spike removal tool generally designated by the reference character 90 is illustrated. Spike removal tool 90 is similar to spike removal tool 30, 50, 60, and 70, in that it has the same elements, including a shank 91, a tool head 92 having a first surface 93, a second surface 93A, engagement elements 94 carried by first surface 93 for engaging disk shaped base 15 of spike element 14, and a bore 95 extending centrally through first surface 93 into tool head 92. The engagement elements 94 function as an engagement means for engaging the disk shaped base 15 of spike element 14.

Spike removal tool 90 differs from spike removal tools 30, 50, 60, and 70, in the embodiment of the engagement elements 94, and the configuration of first surface 93. In this embodiment, the engagement elements 94 consist of a pair of diametrically opposed lugs 97 retained within bores 98 extending through tool head 92. Bores 98 are parallel to the axis of rotation of spike removal tool 90, and the lugs 97 retained therein are also parallel to the axis of rotation of spike removal tool 90. Lugs 97 have an upper end 99 received within bore 98, and terminate with a free end 100 that slopes away from tool head 92 and in a counter clockwise direction with respect to the rotation thereof, much like lugs 77 described in combination with FIG. 12 and FIG. 13. Thus, one side of each lug 97 is longer than the other side, forming an edge 101. In other words, when tool 90 is rotated in a clockwise direction, the shorter side of each lug 97 is leading When rotated in the counter clockwise direction, edges 101 of lugs 97 are leading. The lugs 97 of spike removal tool 90 are preferably roll pins which when introduced into bores 98, securingly press fit against the bores 98 as a result of the roll pins being outwardly biased. As a result of such a configuration, the lugs 97 may be easily introduced to the tool head 92, or easily removed if damaged through use. Additionally, since the roll pins making up lugs 97 are configured to be outwardly biased, the diameter of the bores 98 need not be absolutely precise, since the roll pins can accommodate slight tooling imperfections leading to varying bore diameters. Although dowel pins may be used for lugs 97, the tooling of the bores 98 must be very precise for the dowel pins to securingly press fit within the bores 98.

First surface 93 of spike removal tool 90 is generally planar leading up to countersink 105 which leads into bore 95. The countersink 105 includes a frustoconical surface 106. In operation, tool 90 can be used as a spanner to install a spike element by inserting lugs 97 into the corresponding openings formed in disk shaped base 15 and rotating clockwise. Tool 90 can also be used to remove spike element by inserting lugs 97 in the openings formed in disk shaped base 15 and rotating in a counter clockwise direction. Further, when lugs 97 are inserted in the openings formed in disk shape base 15, frustoconical surface 106 functions as a locating surface engageable about and bearing against an opposing frustoconical surface 107 of said disk shaped base 15 for further engaging spike removal tool 90 to disk shaped base 15. In addition, like spike removal tool 70, if the openings are worn or damaged beyond using, tool 90 can be sued to remove the spike element by engaging outer surface 17 with edges 101 of lugs 97 and turning in a counterclockwise direction as shown in FIG. 14. With edges 101 leading during counterclockwise rotation of tool 90, the edges 101 act as engagement element by cutting into outer surface 17 and thus engaging the spike element.

Figure 17:
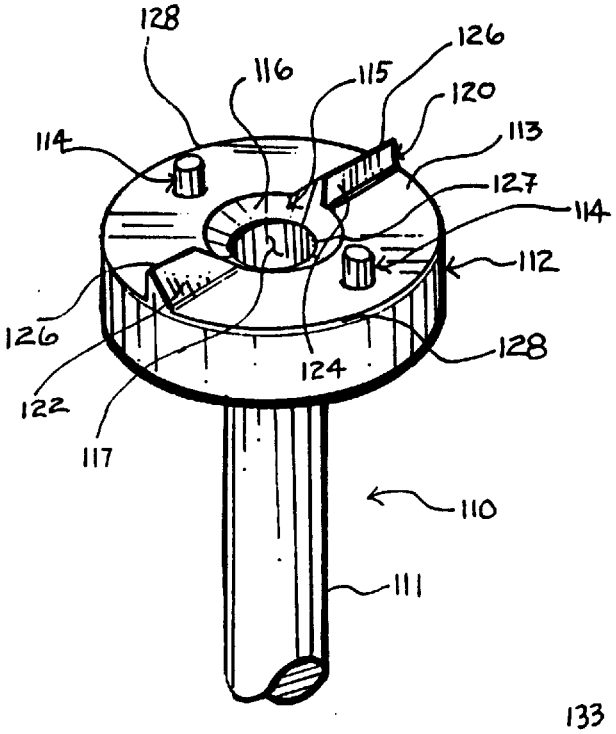
FIG. 17 is a perspective view of still an alternate embodiment of the instant invention.
Figure 18:
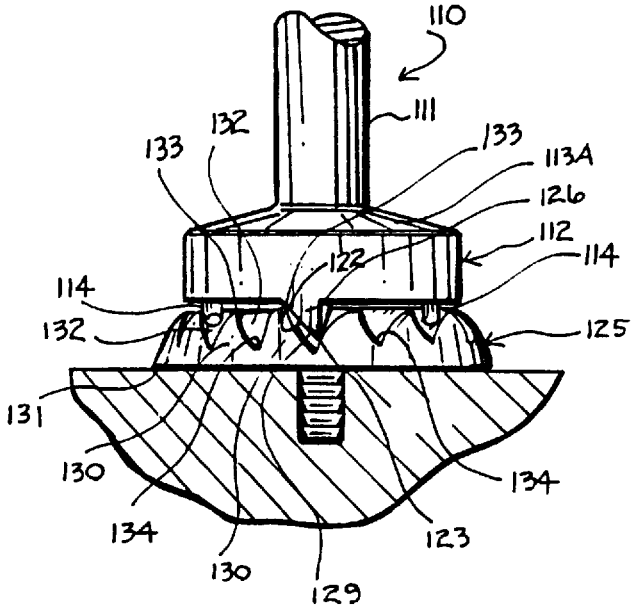
FIG. 18 is a side elevational view of the embodiment first shown in FIG. 17.

Turning now to FIG. 17 and FIG. 18, yet another embodiment of a spike removal tool generally designated by the reference character 110. Spike removal tool 110 includes all of the elements shown in combination with spike removal tool 90 including a shank 111, a tool head 112 having a substantially planar first surface 113, a second surface 113A, first engagement elements 114 carried by first surface 113 which may either be engagement element lugs 97 or lugs 77 illustrated in combination with FIG. 1G and FIG. 1 respectively as shown as desired, and a counter sink 115 defined by frustoconical surface 116 leading into bore 117 extending centrally through first surface 113 into tool head 112.

Spike removal tool 110 differs from spike removal tool 90 in that first surface 113, as opposed to first surface 93 of spike removal tool 90, further includes second engagement elements 120. Second engagement elements 120 are projections for engaging spike element 125 which is a Softspikes® spike element, and in this embodiment, includes a plurality of blades 126 extending from first surface 113. Preferably the plurality of blades 126 includes two diametrically opposed blades 126 radiating outward from the countersink 115, but will be understood that more than two blades 126 may be used, or even one may be used. Blades 126 each extend from proximate an upper peripheral edge 127 of countersink 115 to proximate a peripheral edge 128 of first surface 113. To enhance the introduction and engagement with spike element 125, each blade 126 includes a rear sloped surface 122 sloped in the direction of rotation for the removal of the spike element 125, a front surface 124 generally perpendicular to first surface 113, and terminates in a surface 129 sloping away from tool head 112 and in a counter clockwise direction with respect to the rotation thereof, and further sloping away from rear sloped surface 122. Thus, one side of each blade 126 is longer than the other side, forming an edge 123. It will be understood that the first engagement elements 114 and the second engagement elements 120, function as an engagement means for engaging the spike element 125.

The Softspikes® Spike element 125, embodied in U.S. Pat. No. 5,259,129, and other patents pending, includes a plurality of outwardly radiating fins 130 extending upwardly from a base 131. Each of the plurality of fins 130 includes a sloping forward surface 132, a crest 133, and are separated by valleys 134.

In operation, tool 110 can be used as a spanner to install a spike element by inserting the lugs making up the first engagement elements 114 into the corresponding openings (although not herein specifically shown) formed in spike element 125, and correspondingly inserting the blades 126 proximate a corresponding of one of said valleys such that portions of the sloped surface 122 of each blade functions as a locating surface engageable and bearing against portions of forward surface 132 of fin 130. When inserted upon spike element 125, surface 129 functions as a guiding surface for running across portions of the crest 133 of the fin 30 for guiding the spike removal tool 110 upon the spike element 125 and for guiding the lugs making up the first engagement elements 114 into the openings formed in the spike element 125. Once the spike removal tool 110 is inserted upon the spike element 125, installation of the spike element can take place upon rotation of the spike removal tool 110 in a clockwise direction, or removal of the spike element can take place upon rotation of the spike removal tool 110 in a counterclockwise direction. In addition, if the openings are worn or damaged beyond using, tool 110 can be used to remove spike element 125 by engaging portions of the fins 130 with the edges of the lugs making up the first engagement elements 114, and the free edges 123, the sloped surface 122 or the front surface 124 of blades 126, and turning in either a clockwise or counterclockwise direction to either install or remove the spike element 125.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

I claim:

1. A spike removal tool for removing spike elements from sporting shoes, the spike elements rotatable in a first direction relative the shoe for installation and rotatable in a second direction relative the shoe for removal, the tool comprising:

a tool head having an axis of rotation, rotatable in the second direction to engage the spike element and including a first surface, a second surface opposing the first surface, a plurality of projections extending from the first surface, the plurality of projections configured to engage the spike element upon rotation in the second direction and configured to engage the spike element and rotate the spike element in the first direction, and a bore extending centrally through the first surface into the tool head toward the second surface along the axis of rotation;

the plurality of projections include a pair of diametrically opposed lugs each having a surface sloping away from said tool head, said surface sloping away from said tool head in the second direction and terminating in an edge at a side of said lugs; and a shank extending from the second surface of the tool head and having an axis of rotation generally perpendicular to the first surface of the tool head and co-axial with the bore.

2. A spike removal tool for removing spike elements from sporting shoes, the spike elements rotatable in a first direction relative the shoe for installation and rotatable in a second direction relative the shoe for removal, the tool comprising:

a tool head having an axis of rotation, the rotatable in the second direction to engage the spike element and including a first surface, a second surface opposing the first surface, a plurality of projections extending from the first surface, the plurality of projections configured to engage the spike element upon rotation in the second direction and configured to engage the spike element and rotate said spike element in the first direction, and a bore extending centrally through the first surface into the tool head toward the second surface along the axis of rotation;

the plurality of projections include a pair of diametrically opposed lugs each having a surface sloping away from said tool head, said surface sloping away from said tool head in the second direction and terminating in an edge at a side of said lugs;

a shank extending from the second surface of the tool head and having a first end and an axis of rotation generally perpendicular to the first surface of the tool head and co-axial with the bore; and a device for removably receiving the first end of the shank and for rotating the tool head in the second direction.

3. A spike removal tool as claimed in claim 2 wherein said device is a handle containing a socket for receiving said first end of said shank.

4. A golf spike tool for installing and removing spike elements from golf shoes, the spike elements rotatable in a first direction relative the shoe for installation and rotatable in a second direction relative the shoe for removal, the tool comprising:

a tool head having an axis of rotation, and including a first surface, a second surface opposing the first surface, engagement means carried by the first surface for engaging the spike element, and a bore extending centrally through the first surface into the tool head toward the second surface along the axis of rotation;

said engagement means including a pair of diametrically opposed lugs for engaging said spike element and rotating said spike element in one of the first and second directions, each lug having a surface sloping away from said tool head, said surface sloping away from said tool head in the second direction and terminating in an edge at a side of said lugs, said edges engaging said spike element when rotated in the second direction; and a shank extending from the second surface of the tool head and having an axis of rotation generally perpendicular to the first surface of the tool head and co-axial with the bore.

5. A tool as claimed in claim 4 further including a handle having a socket for removably receiving said shank.

6. A tool as claimed in claim 4, wherein said engagement means further includes a pair of diametrically opposed blades, each blade having a rear sloped surface sloping away from said tool head, said rear sloped surface sloping away from said tool head in the second direction and terminating in a surface, said rear sloped surface engaging said spike element when rotated in the second direction.

* * * * *